US006459992B1

(12) United States Patent
Freedman et al.

(10) Patent No.: US 6,459,992 B1
(45) Date of Patent: Oct. 1, 2002

(54) METHOD AND APPARATUS FOR DETERMINING LOGGING TOOL DISPLACEMENTS

(75) Inventors: Robert Freedman, Houston, TX (US); Luis E. DePavia, Houston, TX (US); Abdurrahman Sezginer, Houston, TX (US)

(73) Assignee: Schlumberger Technology Corporation, Houston, TX (US)

( * ) Notice: Subject to any disclaimer, the term of this patent is extended or adjusted under 35 U.S.C. 154(b) by 78 days.

(21) Appl. No.: 09/598,629

(22) Filed: Jun. 21, 2000

Related U.S. Application Data

(60) Provisional application No. 60/143,393, filed on Jul. 12, 1999.

(51) Int. Cl.[7] ..... G01V 1/40

(52) U.S. Cl. ..... 702/6; 73/152; 324/303

(58) Field of Search ..... 73/152; 324/303, 324/300, 307, 309, 318, 322; 702/2, 6, 7, 8, 141, 142, 147, 149, 150, 152

(56) References Cited

U.S. PATENT DOCUMENTS

| | | | |
|---|---|---|---|
| 5,331,578 | A | 7/1994 | Stieler |
| 5,541,587 | A | 7/1996 | Priest |
| 6,051,973 | A | 4/2000 | Prammer |
| 6,268,726 | B1 * | 7/2001 | Prammer et al. ..... 324/303 |

OTHER PUBLICATIONS

Francis W. Sears, University Physics, 1987, Addison–Wesley Publishing Company, Seventh Edition, p. 35.*

E. Merzbacher, Ed., *Quantum Mechanics,* Ch. 14, pp. 306–308, John Wiley & Sons, Inc., NY (1961).

A. Ralston & H.S. Wilf, Eds., *Mathematical Methods for Digital Computers*, vol. 2, p. 233, John Wiley & Sons, Inc., NY (1967).

L.B.W. Jolley, Ed., *Summations of Series*, 2nd Ed., pp. 4–5, Dover Publications Inc., NY (1961).

* cited by examiner

*Primary Examiner*—John S. Hilten
*Assistant Examiner*—Stephen J. Cherry
(74) *Attorney, Agent, or Firm*—Kevin McEnaney; Brigitte L. Jeffery; John H. Ryberg

(57) ABSTRACT

A method of determining the displacements of a logging tool during a measurement interval of the logging tool in a borehole includes obtaining a set of accelerometer signals corresponding to accelerations of the logging tool along each of three orthogonal axes of the logging tool during the measurement interval. The method further includes calculating a lower bound for the displacements of the logging tool during the measurement interval when the initial velocity and the gravitational acceleration are unknown. The lower bound on the displacements of the logging tool is used to flag the validity of the measurements made by the logging tool.

11 Claims, 5 Drawing Sheets

METHOD AND APPARATUS FOR DETERMINING LOGGING TOOL DISPLACEMENTS

CROSS REFERENCE TO RELATED APPLICATIONS

This application claims priority from U.S. Provisional Application Serial No. 60/143,393, filed Jul. 12, 1999.

BACKGROUND OF THE INVENTION

Well logging involves recording data related to one or more characteristics of a subterranean formation penetrated by a borehole as a function of depth. The record is called a log. Many types of logs are recorded by appropriate downhole instruments placed in a housing called a sonde. The sonde is lowered into the borehole on the end of a cable, and the parameters being logged are measured as the sonde is moved along the borehole. Data signals from the sonde are transmitted through the cable to the surface, where the log is made. FIG. 1 shows an example of a sonde 2 that measures properties of formation 4 surrounding a borehole 6 using the principles of nuclear magnetic resonance (NMR). The NMR sonde 2 includes a magnet assembly 8 and an antenna 10. The magnet assembly 8 produces a static magnetic field $B_0$ in all regions surrounding the sonde 2, and the antenna 10 produces an oscillating magnetic field $B_1$ that is perpendicular and superimposed on the static magnetic field $B_0$. The NMR signal comes ad. from a small resonance volume 12 which has a radial thickness that is proportional to the magnitude of the oscillating magnetic field $B_1$ and inversely proportional to the gradient of the static magnetic field $B_0$. The NMR sonde 2 makes measurements by magnetically tipping the nuclear spins of protons in the formation with a pulse of the oscillating magnetic field, and then detecting the precession of the tipped particles in the resonance volume 12.

As the NMR sonde 2 traverses the borehole 6 to make measurements, it experiences random accelerations due to borehole forces acting on it. These random accelerations result in displacements of the sonde, which may adversely affect the quality of the log. To further explain this point, the resonance volume 12 generally consists of thin cylindrical shells that define a sensitive region extending along the length of the sonde 2 and having a radial thickness of about 1 millimeter. If the NMR sonde 2 moves 1 millimeter or more in the radial direction, the measurements of the T2 spin-spin relaxation times of the protons may be corrupted. Also, the time during which the nuclear spins of the protons in the formation 4 are polarized by the applied magnetic fields depend on the motion of the NMR sonde 2. If the NMR sonde 2 sticks and slips while moving along the direction of the borehole, T1 relaxation-time measurements can be compromised. In another logging mode which estimates the bound fluid volume by first saturating the nuclear spins and then letting them recover during a small time, the measurement mode overestimates the bound fluid volume if the tool moves faster than expected along the longitudinal axis of the borehole 6, or if the tool is radially displaced by more than 1 millimeter during the recovery period.

If the displacements of the sonde during the measurement interval are known, then the portions of the NMR measurements that are distorted by motions of the sonde can be identified and discarded or corrected using appropriate compensation methods. Prior art methods have used a motion detection device, such as a strain gauge, an ultrasonic range finder, an accelerometer, or a magnetometer, to detect the motions of a sonde during a logging operation. In this manner, the motion detection device is used to establish a threshold for evaluating the quality of the log. For example, U.S. Pat. No. 6,051,973 issued to Prammer discloses using accelerometers to monitor peak acceleration values of a logging tool during a measurement interval of the logging tool. The quality of the log is improved by discarding the measurements made during the period that the peak accelerations indicate that the logging tool may have been displaced by more than allowable by the extent of the sensitive region.

SUMMARY OF THE INVENTION

In one aspect, the invention is a method for determining the displacements of a logging tool during a measurement interval of the logging tool in a borehole. The method comprises obtaining a set of accelerometer signals corresponding to accelerations of the logging tool along each of three orthogonal axes of the logging tool during the measurement interval and double integrating the set of accelerometer signals to obtain corresponding displacements of the logging tool as a function of the initial velocity of the logging tool and the gravitational acceleration, wherein the initial velocity of the logging tool and the gravitational acceleration are unknown. The method further comprises assuming a set of feasible initial velocities for the logging tool. For each feasible initial velocity, the method includes estimating the gravitational acceleration, calculating the displacements of the logging tool using the feasible initial velocity and the estimated gravitational acceleration, and determining the maximum of the calculated displacements. The lower bound on the displacements of the logging tool is set to the minimum of the maximum of the calculated displacements.

In another aspect, a method for determining the displacements of a logging tool during a measurement interval of the logging tool in a borehole comprises obtaining a set of accelerometer signals corresponding to accelerations of the logging tool along each of three orthogonal axes of the logging tool during the measurement interval and calculating a tool displacement as a time-series from the accelerometer signals. The method further includes constructing a unique quadratic polynomial of time from the displacement time-series, subtracting the unique quadratic polynomial from the displacement time-series, and setting the lower bound to the maximum of the remainder of the displacement time-series.

Other aspects and advantages of the invention will be apparent from the following description and the appended claims.

DETAILED DESCRIPTION OF THE INVENTION

Embodiments of the invention provide a method for determining displacements of a logging tool during a measurement interval along three orthogonal axes of the logging tool. In general, an accelerometer is used to measure the accelerations of the logging tool along the three orthogonal axes of the logging tool during the measurement interval. The accelerations acquired by the accelerometer, as will be further explained below, have a gravitational portion that is due to gravitational forces acting on the test-mass of the accelerometer and a kinetic portion that is due to the net force acting on the logging tool. The displacements of the logging tool are determined from the estimated kinetic portion of the accelerations.

The displacements of the logging tool may be used to assess the quality of the measurements made by the logging tool. For example, pulse-echo nuclear magnetic resonance (NMR) measurements are time-lapse measurements. For the measurement to be accurate, the sensitive zone of the NMR logging tool needs to substantially overlap with itself through out the measurement duration. Thus, accuracy of NMR logging tools are sensitive to the displacement of the tool during the measurement interval. By determining the displacements of the logging tool during a measurement interval, the validity of the measurements made can be verified. Of course, the invention is not limited to NMR logging tools, but is generally applicable to any logging tool that makes measurements that are sensitive to tool motion.

Figure 1:
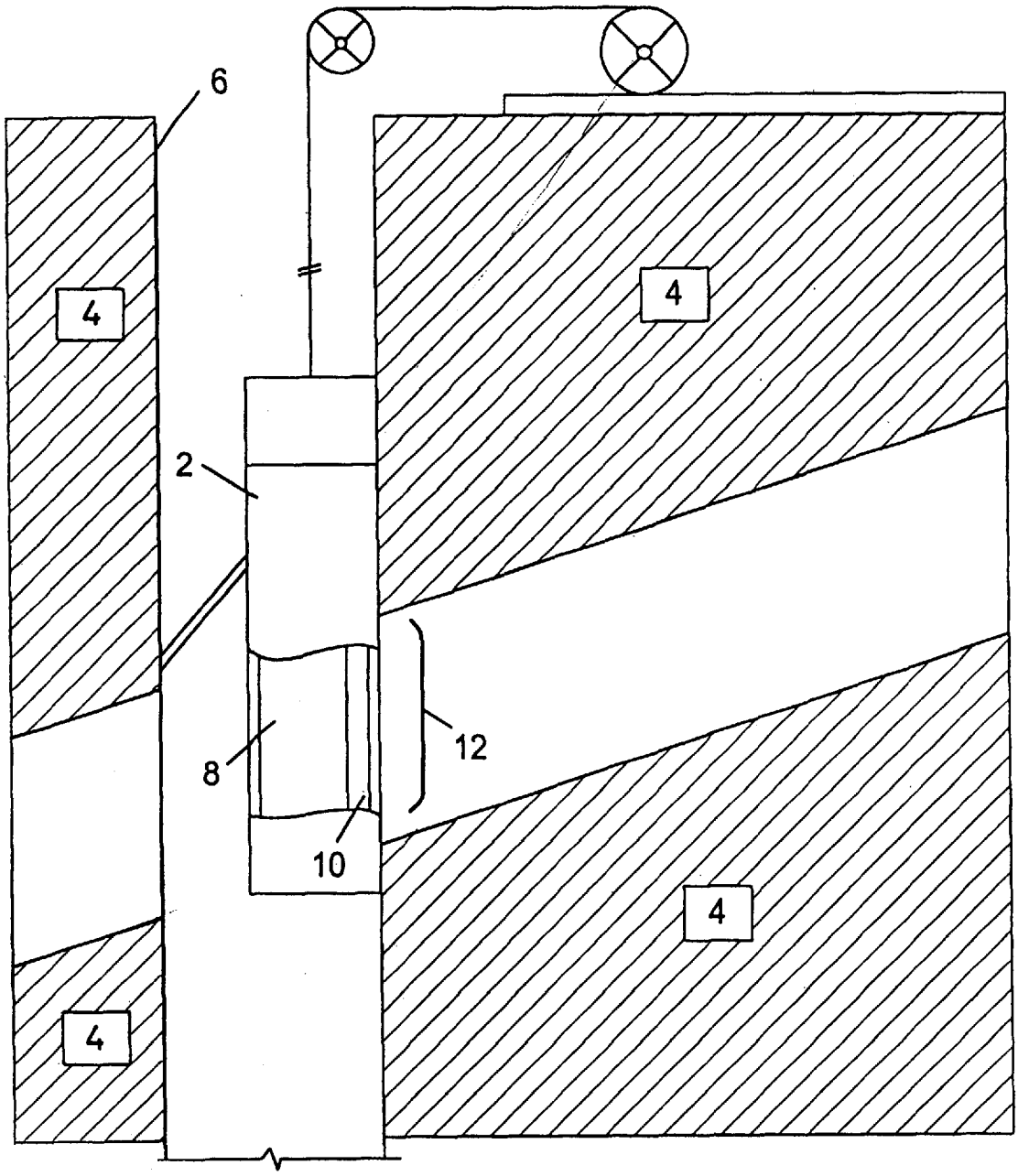
FIGURE 1 (PRIOR ART)
FIG. 1 shows a logging tool suspended in a borehole.
Figure 2:
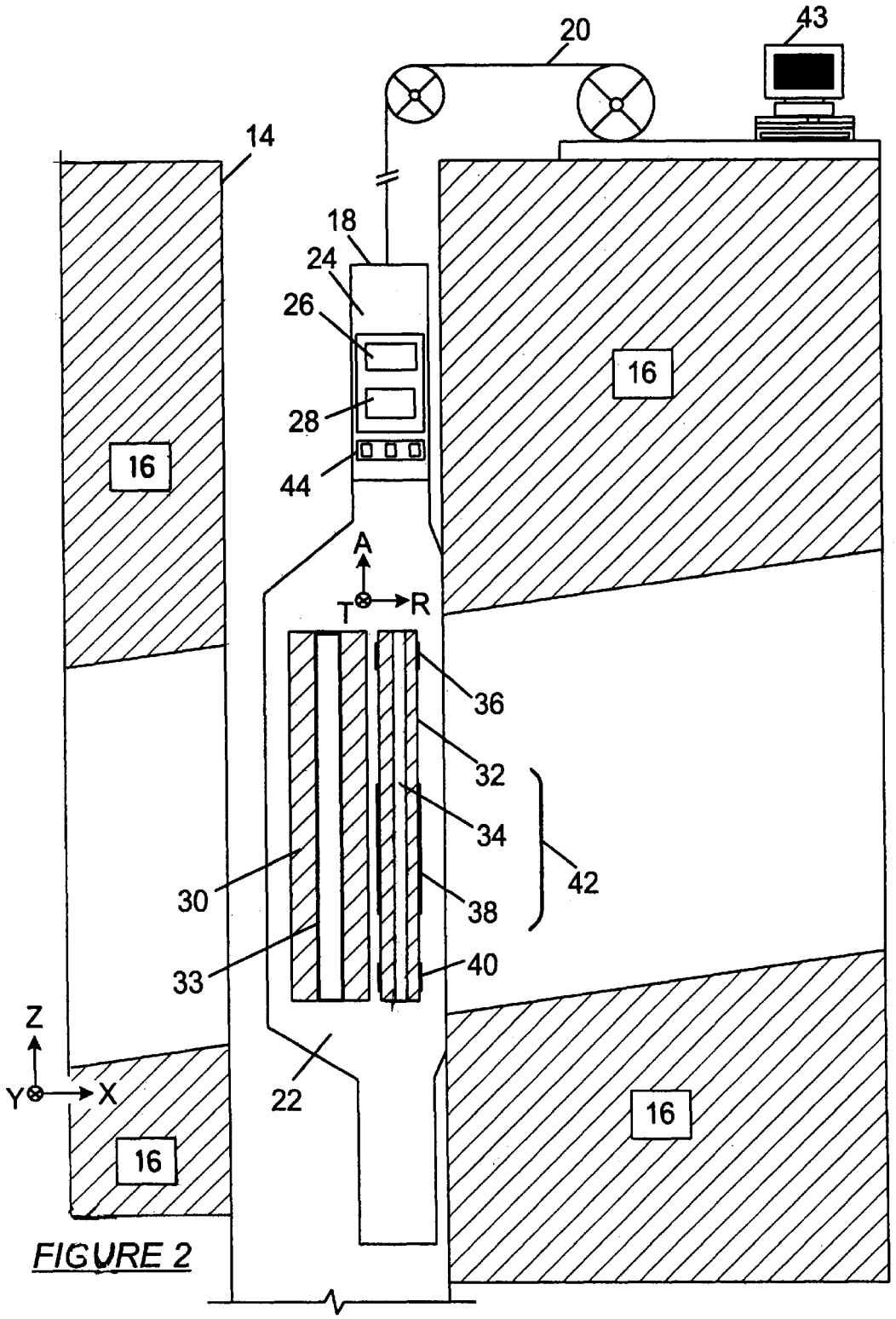
FIG. 2 is a cross section of a logging tool suspended in a borehole according to one embodiment of the invention.

Various embodiments of the invention will now be discussed with reference to the accompanying figures. In order to fully understand the invention, it is helpful to consider a specific configuration of a logging tool. However, it should be clear that the invention is not limited to the specific configuration of the logging tool discussed herein. FIG. 2 shows a borehole 14 which traverses a subterranean formation (or formations) 16. A logging tool 18 is suspended in the borehole 14 on the end of a cable 20. The logging tool 18 includes a sonde 22 which measures characteristics of the formation 16 using NMR principles. An electronics cartridge 24 is mounted on the sonde 22. The electronics cartridge 24 includes a pulse generator 26 and may also include a memory 28 for storing data. In one embodiment, the sonde 22 includes a permanent magnet 30 which produces a static magnetic field $B_0$ and an antenna 32 which produces an oscillating magnetic field $B_1$. The permanent magnet 30 circumscribes a protective sleeve 33. The sleeve 33 provides a conduit for receiving electrical conductors 35 (shown in FIG. 3) which transmit signals to the electronic cartridge 24. In one embodiment, the antenna 32 includes a ferrite core 34 on which radio-frequency (RF) coils 36, 38, 40 are mounted. The RF coil 38 has a variable resonant frequency, or receives a variable frequency RF power, which may be adjusted to select the depth of investigation of the logging tool 18.

The RF coils 36, 38, 40 generate the oscillating magnetic field $B_1$ in response to signals from the pulse generator 26. The pulse generators 26 may be controlled, for example, to generate NMR detection sequences such as a Carr-Purcell-Meiboom-Gill (CPMG) sequence (not shown). The NMR detection sequence may be applied, for example, to determine the T2 spin-spin relaxation times of hydrogen nuclei in the formation 16. The static magnetic field $B_0$ produced by the permanent magnet 30 and the oscillating magnetic field $B_1$ produced by the antenna 32 create a resonance volume 42 in which the characteristics of the formation 16 can be investigated. In operation, the pulse generator 26 is controlled to produce a desired NMR detection sequence. The spin echo signals from the resonance volume 42 are received by the RF coils 36, 38, 40. In one embodiment, the spin echo signals are stored in the memory 28 and later transmitted uphole. The spin echo signals may be transmitted uphole via telemetry, in which case, one or more receivers (not shown) will be provided to receive the signals. The spin echo signals may be amplified by amplifiers (not shown) and stored for further processing by a computer 43. For example, the spin echo signals may be analyzed to produce a distribution of T2 times, and the properties of the formation 16 may be obtained from this distribution.

Figure 3:
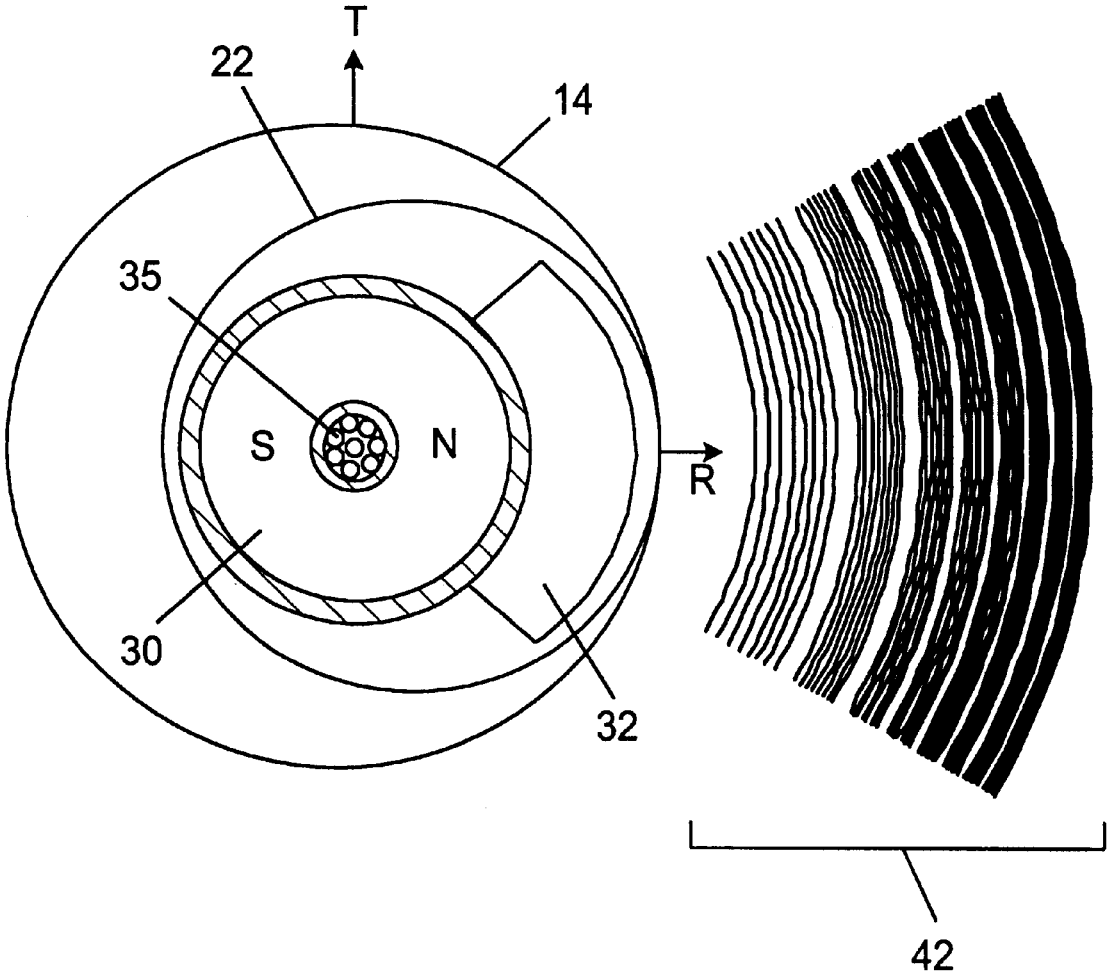
FIG. 3 depicts a horizontal cross section of the logging tool shown in FIG. 2.

As shown in FIG. 3, the resonance volumes 42 are typically shaped like a thin sheet with a thickness on the order of 1 millimeter. A particular resonance volume 42 is excited depending on the frequency of operation. Thus, if the logging tool 18 moves 1 millimeter or more in the radial direction, the T2 spin-spin relaxation times may be corrupted. Other NMR measurements, such as T1 relaxation time measurements, may also be compromised if the logging tool 18 accelerates in a direction along the longitudinal axis of the borehole 14 during a measurement interval. Thus, as shown in FIG. 2, an accelerometer 44 is provided to sense the motion of the logging tool 18 during a logging operation. In one embodiment, the accelerometer 44 is mounted in the electronics cartridge 24, but may be mounted elsewhere as long as it is positioned as close as possible to the sonde 22 or the part of the logging tool 18 that is most sensitive to motion. The measurements made by the accelerometer 44 may be transmitted uphole via telemetry and processed, for example, by the computer 43.

For discussion purposes, a Cartesian coordinate system is fixed on the logging tool 18. The coordinate system has three mutually perpendicular axes, including radial (R), tangential (T), and axial (A) axes. The positive axial direction points up along the axis of the borehole 14, and the positive radial direction points into the formation 16. The tangential axis is perpendicular to both the radial and axial axis and tangent to the wall of the borehole 14 where the logging tool 18 contacts the wall. The logging tool 18 is moved along the axis of the borehole 14 to make measurements. The accelerometer 44 includes, for example, three uniaxial sensors, each of which has a sensitive axis aligned with one of the axes of the logging tool 18. The accelerometer 44 measures instantaneous acceleration of the logging tool 18 along the radial, tangential, and axial directions as the logging tool 18 makes measurements.

When the logging tool 18 is at rest or moving at a constant velocity in the earth's gravitational field, the accelerometer 44 measures the radial component ($g_R$), the tangential component ($g_T$), and the axial component ($g_A$) of the acceleration due to gravity ($g=981\ cm/s^2$). The components of the acceleration due to gravity (g) are referred to herein as "gravitational accelerations." These gravitational accelerations do not result in displacements of the logging tool 18 because the gravitational force on the logging tool 18 is balanced by the time average of the tension in the cable 20 and the friction with the formation 16 and the fluid in the borehole 14.

During a logging operation, however, the variable stretch in the cable 20 and the rough surface of the wall of the borehole 14 can exert fluctuating forces on the logging tool 18. The fluctuations in the net force acting on the logging tool 18 causes the logging tool 18 to accelerate and decelerate. This acceleration is different from the acceleration due to gravity and is called "kinetic acceleration" because it results in displacements of the logging tool 18. The kinetic acceleration is equal to the second time-derivative of the position of the logging tool 18 measured with respect to an inertial reference. The kinetic acceleration has a radial component $\ddot{x}_R$, tangential component $\ddot{x}_T$, and an axial component $\ddot{x}_A$. Following standard conventions, dots above variables denote time-derivatives. The accelerometer 44 also measures the kinetic accelerations along the three axes of the logging tool 18. The total acceleration measured along the radial, tangential, and axial axes is then the sum of the gravitational and the kinetic accelerations.

The three-axis gravitational acceleration provides information on the orientation of the logging tool 18 with respect to the set of fixed axes XYZ. This information can be used to determine the deviation of the borehole 14 and the relative bearing of the logging tool 18 in the borehole 14. The kinetic acceleration, on the other hand, can be used to determine the displacements the logging tool 18. If the orientation of the logging tool 18 does not change during the data acquisition period, the gravitational accelerations along each axis of the logging tool 18 will remain constant. The kinetic accelerations of the logging tool 18 can then be determined by subtracting a constant from the acceleration data. In reality, however, the orientation of the logging tool 18 is not constant, but is generally slowly varying. Thus, a method for determining the gravitational accelerations of the logging tool 18 is needed. Embodiments of the invention provide a method for estimating the gravitational accelerations and removing the gravitational accelerations from the acceleration data so that the displacements of the logging tool 18 can be estimated.

The problem addressed by the invention is akin to a physicist estimating the distance traveled by the elevator in which she is riding. The physicist is reading the apparent weight of an apple of known mass on a balance inside the elevator. As the elevator accelerates going up or decelerates going down, the balance reading increases. As the elevator decelerates going up or accelerates going down, the balance reading decreases. The physicist could calculate the distance traveled by the elevator if she were not handicapped by two factors: (1) the building has an unknown tilt and (2) she is distracted at the beginning so she does not know the balance reading at rest or the initial velocity of the elevator when she starts her measurements. The physicist can determine the changes in acceleration which tells her the position of the elevator up to an arbitrary quadratic polynomial of time. Given this incomplete information, the physicist can only put a lower bound on how much the elevator might have traveled since she started her measurements.

For discussion purposes, let a(t) be the acceleration measured along any one of the axes of the logging tool 18 at time $t \geqq t_1$, where $t_1$ is the time that the data acquisition begins. The acceleration measured by the accelerometer 44 includes the kinetic accelerations and the gravitational accelerations of the logging tool 18. That is, $$a(t)=\ddot{x}(t)-g_x \tag{1}$$

where $\ddot{x}(t)$ is the kinetic acceleration of the logging tool 18 due to all forces acting on the logging tool and g, is the component of the acceleration due to gravity, i.e., gravitational acceleration, in the x-direction, ie., along one of the axes of the logging tool 18. The tool position x(t) along one of the axes of the logging tool 18, generally denoted as the x-direction, at time t is given by the following expression:

$$x(t) = x_1 + (t - t_1)\dot{x}_1 + \int_{t_1}^{t}\left[\int_{t_1}^{\bar{t}_1} \ddot{x}(\bar{t}_2)d\bar{t}_2\right]d\bar{t}_1 \tag{2}$$

where $x_1$ is the initial position $\dot{x}_1$ is the initial velocity of the logging tool 18 at time $t_1$. When equation (1) is substituted into equation (2), the following expression for the tool displacement is obtained:

$$x(t) - x_1 \cong (t - t_1)\dot{x}_1 + \frac{g_x}{2}(t - t_1)^2 + \int_{t_1}^{t}\left[\int_{t_1}^{\bar{t}_1} a(\bar{t}_2)d\bar{t}_2\right]d\bar{t}_1 \tag{3}$$

where it is assumed that $g_x$ is approximately constant over the data acquisition period. Because $g_x$ depends on the orientation of the axes of the logging tool 18 relative to the set of fixed reference axes XYZ, this assumption is equivalent to assuming that the orientation of the logging tool 18 slowly varies with time. This assumption is sensible for short data acquisition periods, which are typically on the order of 0.6 seconds or shorter for the CPMG measurement sequence in NMR logging.

Two quantities in equation (3), $g_x$, the gravitational acceleration, and $\dot{x}_1$, the initial velocity of the logging tool 18, are unknown. Because, the parameter of interest is the magnitude of the displacement of the logging tool 18 from an initial position, and not the actual position of the logging tool 18 in the borehole 14, the knowledge of $x_1$ is not necessary. The displacement $x(t)-x_1$ is, therefore, renamed as x(t) from here on. In other words, the initial position is arbitrarily chosen as the origin of the coordinate system. The notation used for the tool displacement from here on emphasizes its functional dependence on the initial velocity $\dot{x}_1$, and the gravitational acceleration $g_x$, as shown in equation (4) below.

$$x(t, \dot{x}_1, g_x) \cong (t - t_1)\dot{x}_1 + \frac{g_x}{2}(t - t_1)^2 + \int_{t_1}^{t}\left[\int_{t_1}^{\bar{t}_1} a(\bar{t}_2)d\bar{t}_2\right]d\bar{t}_1 \tag{4}$$

In practice, the output of the accelerometers 44 are not continuously recorded in time, but a finite number of samples are acquired with a constant time interval Δ. Assuming that the accelerometer acquires $n_s$ samples in the x-direction, i.e., along one of the axes of the logging tool 18, then $$a_n=\ddot{x}_n-g_x \text{ for } n=1, \ldots n_s \tag{5}$$

where $a_n$ is the acceleration measured in the x-direction at the time t=nΔ. The term $\ddot{x}_n$ is the kinetic acceleration of the logging tool 18, and $g_x$ is the component of the gravitational acceleration in the x-direction. A single integration of the acceleration data gives the set of velocities of the logging tool 18. The acceleration data can be integrated using a variety of numerical methods. One suitable method is the trapezoid rule for numerical integration. When the trapezoid rule is applied to equation (5), the following expression is obtained:

$$\dot{x}_{n+1} = \dot{x}_n + \frac{\Delta}{2}(\ddot{x}_{n+1} + \ddot{x}_n) \text{ for } n = 1, \ldots, n_s - 1 \tag{6}$$

Equation (6) gives the velocity at the $(n+1)^{th}$ time step in terms of the velocity at the previous time step plus the change in the velocity due to the acceleration. Repeated application of the recursion relation (6) and use of equation (5) leads, after n time steps, to:

$$\dot{x}_n = \dot{x}_1 + (n - 1)g_x\Delta + \frac{\Delta}{2}(a_1 + 2a_2 + 2a_3 + \ldots + 2a_{n-1}a_n) \tag{7}$$

-continued for $n = 2, 3, \ldots n_s$

Using the trapezoid rule a second time to integrate equation (6), the following expression is obtained:

$$x_{n+1} = x_n + \frac{\Delta}{2}(\dot{x}_{n+1} + \dot{x}_n) \text{ for } n = 1, \ldots, n_s - 1 \tag{8}$$

Equations (7) and (8) lead to:

$$x_n(\dot{x}_1, g_x) = (n-1)\dot{x}_1\Delta + \frac{(n-1)^2\Delta^2 g_x}{2} + \Delta^2\left[\frac{2n-3}{4}a_1 + (n-2)a_2 + (n-3)a_3 + \ldots + 3a_{n-3} + 2a_{n-2} + a_{n-1} + \frac{1}{4}a_n\right] \quad n = 2, 3, \ldots, n_s \tag{9}$$

Equation (9) shows the explicit functional dependence of the displacement on the unknown initial velocity $\dot{x}_1$ and gravitational acceleration $g_x$.

Figure 4:
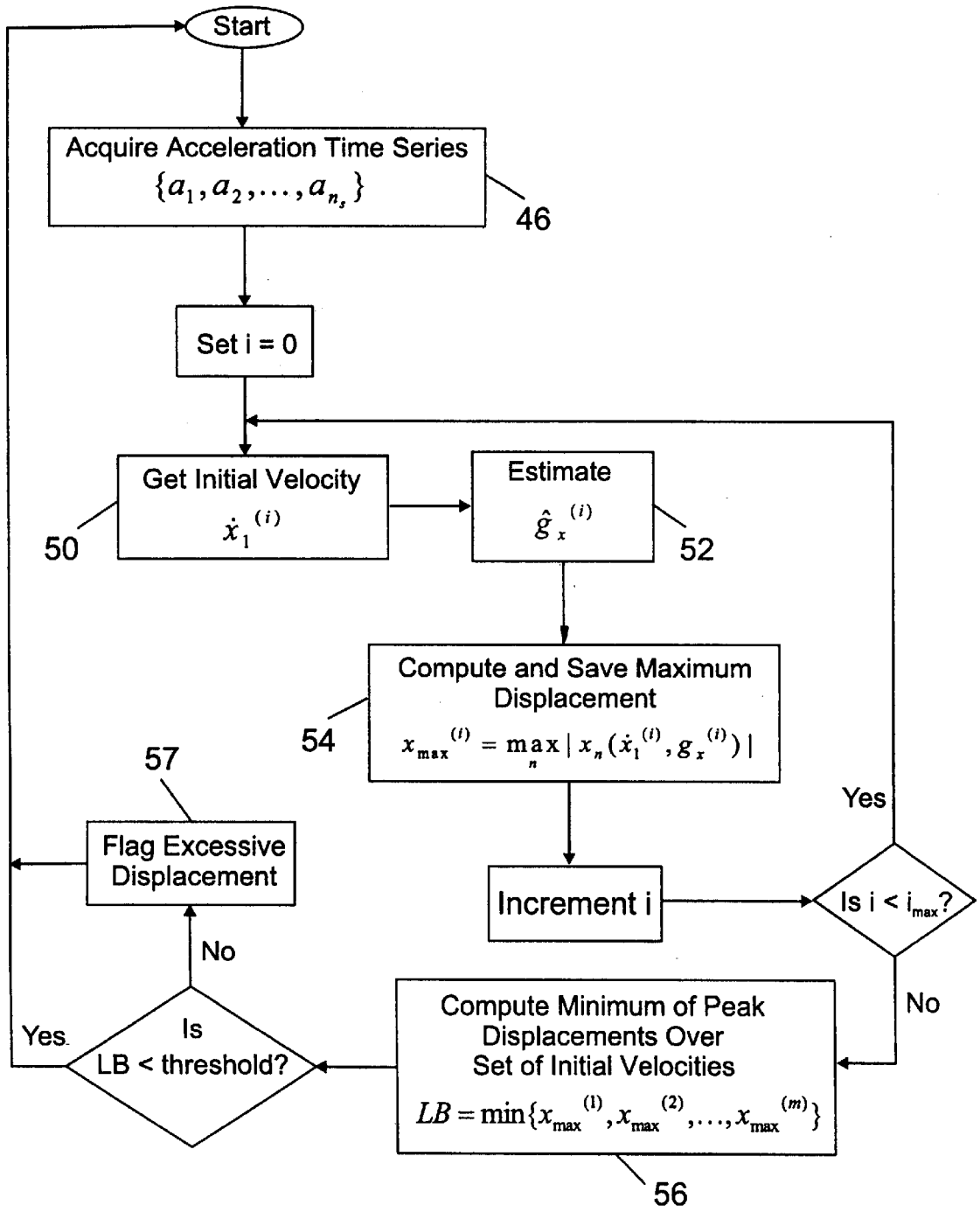
FIG. 4 is a flow chart illustrating a method for determining the displacements of a logging tool according to one embodiment of the invention.

FIG. 4 illustrates a method for estimating a lower bound on displacements of the logging tool 18 given that $\dot{x}_1$ and $g_x$ are unknown. The method starts by acquiring $n_s$ acceleration samples during a measurement interval of the logging tool 18 (shown at 46). The next step is to determine the particular values of +ė,cir ẋ+ee $_1$ and $\hat{g}_x$ that minimize the estimated tool displacement in the following sense:

$$\hat{g}_x(\dot{x}_1) = \arg\min_{g_x} \sum_{n=2}^{n_s} x_n^2(\dot{x}_1, g_x) \tag{10}$$

$$\hat{\dot{x}}_1 = \arg\min_{\dot{x}_1}\left\{\max_n |x_n(\dot{x}_1, \hat{g}_x(\dot{x}_1))|\right\} \tag{11}$$

The notation "$\arg_p \min f(p)$" denotes the value of the parameter p that minimizes the expression f(p). The gravitational acceleration $\hat{g}_x(\dot{x}_1)$ is estimated by minimizing the sum of squares of the displacement time-series. This value is readily calculated by setting the derivative of the sum of squares with respect to $g_x$ to zero:

$$\hat{g}_x(\dot{x}_1) = -\frac{2\sum_{n=1}^{n_s} x_n(\dot{x}_1, 0)(n-1)^2\Delta^2}{\sum_{n=1}^{n_s}((n-1)\Delta)^4} \tag{12}$$

The minimization in equation (11) with respect to the initial velocity $\dot{x}_1$ is done by searching for the minimum through a set of user-supplied initial velocities $\{\dot{x}_1^{(1)}, \ldots, \dot{x}_1^{(m)}\}$. An $i^{th}$ initial velocity from the set of user-supplied initial velocities is first obtained (shown at 50). For each $i^{th}$ initial velocity, an estimate $\hat{g}_x^{(i)}$ is next calculated using equation (12) above (shown at 52). For each $i_{th}$ initial velocity, there will be a time-series of $n_s$ displacements corresponding to the $n_s$ acceleration samples and an estimated value of the gravitational acceleration. In step 54, the maximum of the $n_s$-long displacement time-series is selected. The steps 46–54 are repeated until all the displacements for the set of user-supplied initial velocities have been computed. In step 56, the minimum of the maximum displacements computed in step 54 is selected as the lower bound for the displacement of the logging tool 18 during data acquisition. The initial velocity corresponding to this lower bound is the solution to equation (11). The lower bound for the displacement of the logging tool 18 can be used to assess the measurements made by the logging tool 18. For example, the condition that the lower bound for the peak displacement of the logging tool 18 exceeds a certain fraction of the thickness of the resonance volume 42 can be used to flag the NMR measurement as invalid (shown at 57).

In an alternate embodiment, $g_x$ is assumed to be approximately constant during the data acquisition period. In this case, the mean value of the acceleration samples acquired in step 45 may provide another estimate of $\hat{g}_x$. This mean value $\hat{g}_{x,mean}$ may replace the estimate $\hat{g}_x(\dot{x}_1)$ calculated in step 52.

Figure 5:
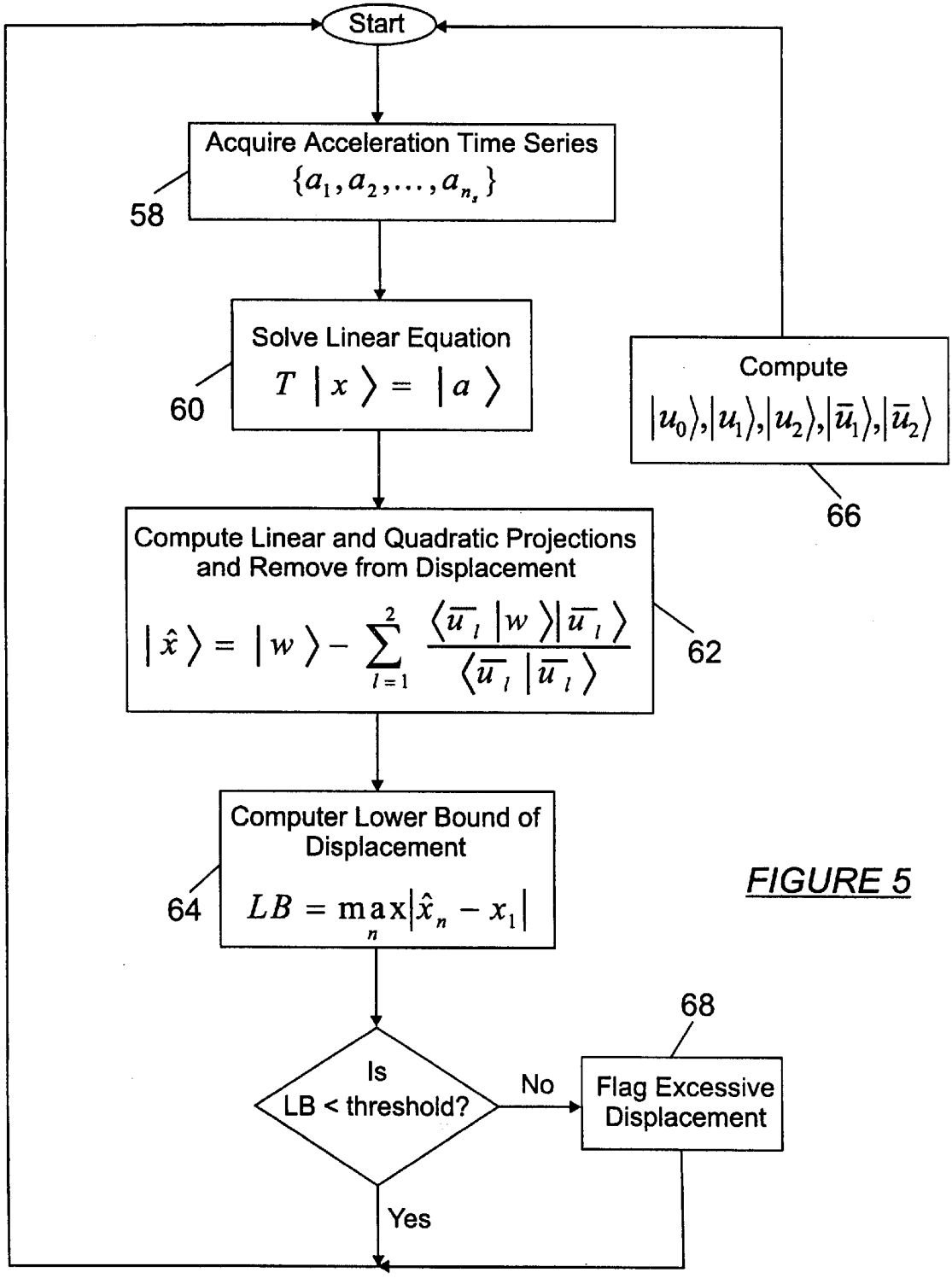
FIG. 5 is a flow chart illustrating a method for determining the displacements of a logging tool according to another embodiment of the invention.

FIG. 5 illustrates an alternative method for estimating a lower bound for the displacement of the logging tool 18. Because the tool displacement is known up to an arbitrary quadratic polynomial of time, if any quadratic polynomial of time from the displacement time-series is subtracted, the result will also be a displacement time-series that is consistent with the measured acceleration time-series. There is a unique quadratic polynomial that will minimize the sum of squares of the resulting time-series. This is the well-defined, unique lower bound for the tool displacement in the least-squares sense. In this method, the motion of the logging tool 18 is represented by the following expression:

$$\frac{d^2x}{dt^2} = \ddot{x}(t) \tag{13}$$

where $\ddot{x}(t)$ is the acceleration of the logging tool 18 along any one of the tool axes, denoted by x, at time t. The derivative $$\frac{d^2x}{dt^2}$$

is then replaced by a central-difference approximation, as shown in equation (14) below:

$$\frac{x_{n+1} - 2x_n + x_{n-1}}{\Delta^2} = \ddot{x}_n \tag{14}$$

where Δ is the time spacing between $x_{n+1}$ and $x_n$. For n=1 to $n_s$, where $n_s$ is the number of acceleration samples acquired along any one of the tool axes with sample spacing Δ, a system of $n_s$ equations can be written using equation (14) above. The system of equations can be expressed in matrix form as follows:

$$T\begin{bmatrix} x_1 \\ x_2 \\ \vdots \\ x_{n_s} \end{bmatrix} = \begin{bmatrix} \ddot{x}_1\Delta^2 - x_0 \\ \ddot{x}_2\Delta^2 \\ \vdots \\ \ddot{x}_{n_s}\Delta^2 - x_{n_s+1} \end{bmatrix} \tag{15}$$

where $$T=\begin{bmatrix} -2 & 1 & 0 & \cdots & 0 \\ 1 & -2 & 1 & \cdots & 0 \\ \vdots & 1 & -2 & \cdots & 0 \\ \vdots & 0 & 1 & \cdots & 0 \\ 0 & 0 & \cdots & 1 & -2 \end{bmatrix}$$

When equation (5) is substituted into equation (15), the following expression is obtained:

$$T\begin{bmatrix} x_1 \\ x_2 \\ \vdots \\ x_{n_s} \end{bmatrix}=\begin{bmatrix} (a_1+g_x)\Delta^2-x_0 \\ (a_2+g_x)\Delta^2 \\ \vdots \\ (a_{n_s}+g_x)\Delta^2-x_{n_s+1} \end{bmatrix} \tag{16}$$

In this notation, time-series are represented by column vectors. The solution to the matrix equation (16) above is a tool displacement vector $x=\{x_1, x_2, \ldots, x_{n_s}\}$, where $x_0$ and $x_{n_s+1}$ are the boundary values of the displacements of the logging tool 18.

In the following discussion, it is convenient to use Dirac's notation for ket and bra (see Merzbacher, E., Quantum Mechanics, John Wiley & Sons, 1961). Let $|x\rangle$ represent the displacement vector and let $|a\rangle$ represent the vector on the right-hand side of equation (16). Then equation (16) can be rewritten as follows:

$$T|x\rangle=|a\rangle \tag{17}$$

The solution to equation (17) is obtained by inverting the matrix T and multiplying the vector $|a\rangle$ by the inverted matrix T:

$$|x\rangle=T^{-1}|a\rangle \tag{18}$$

As shown in equation (15), the matrix T is in tridiagonal form and can be readily inverted. See, for example, Ralston, A. and Wilf, H. S., Editors, Mathematical Methods for Digital Computers, Vol. 2, John Wiley & Sons, 1967. It should be noted that the acceleration data provides the values for the elements of the vector $|a\rangle$. The boundary conditions $x_0=x_{n_s+1}=0$ are used in computing the vector $|a\rangle$. The result does not depend on the choice of the boundary conditions as the operation of subtracting a quadratic polynomial of time undoes the effect of the boundary values.

The method illustrated in FIG. 5 starts by acquiring $n_s$ acceleration samples during a measurement interval of the. logging tool 18 (shown at 58). The next step (shown at 60) involves solving for the displacement vector $|x\rangle$ using equation (18). The method estimates the displacements of the logging tool 18 by removing the projections of $|x\rangle$ onto orthogonal vectors that represent constant, linear, and quadratic time dependencies from $|x\rangle$. Consider a subspace consisting of three linearly independent vectors $|u_0\rangle$, $|u_1\rangle$, and $|u_2\rangle$ in an $n_s$-dimensional vector space, where:

$$|u_0\rangle=\begin{bmatrix} 1 \\ 1 \\ 1 \\ \vdots \\ 1 \end{bmatrix}, |u_1\rangle=\begin{bmatrix} 1 \\ 2 \\ 3 \\ \vdots \\ n_s \end{bmatrix}, |u_2\rangle=\begin{bmatrix} 1 \\ 4 \\ 9 \\ \vdots \\ n_s^2 \end{bmatrix} \tag{19}$$

These vectors are the samples of elementary polynomials, e.g., 1, t, $t^2$ which are linearly independent. Their linear combinations span samples of any quadratic polynomial of time. Orthonomal vectors can be constructed from the vectors $|u_0\rangle$, and $|u_1\rangle$, $|u_2\rangle$ by the Gramm-Schmitt orthogonalization procedure:

$$|\bar{u}_0\rangle=|u_0\rangle \tag{20a}$$

$$|\bar{u}_1\rangle=|u_1\rangle-\frac{\langle\bar{u}_0\mid u_1\rangle|\bar{u}_0\rangle}{\langle\bar{u}_0\mid\bar{u}_0\rangle} \tag{20b}$$

$$|\bar{u}_2\rangle=|u_2\rangle-\frac{\langle\bar{u}_1\mid u_2\rangle|\bar{u}_1\rangle}{\langle\bar{u}_1\mid\bar{u}_1\rangle}-\frac{\langle\bar{u}_0\mid u_2\rangle|\bar{u}_0\rangle}{\langle\bar{u}_0\mid\bar{u}_0\rangle} \tag{20c}$$

The linear and quadratic time dependencies are removed from the displacement vector $|x\rangle$ computed in step 60 by subtracting the projection of the displacement vector $|x\rangle$ along the orthogonal vectors $|\bar{u}_1\rangle$ and $|\bar{u}_1\rangle$ in equations (20b) and (20c), shown at 62. That is, $$|\hat{x}\rangle=w-\sum_{l=1}^{2}\frac{\langle\bar{u}_l\mid w\rangle|\bar{u}_l\rangle}{\langle\bar{u}_l\mid\bar{u}_l\rangle} \tag{21}$$

where $w=|x\rangle$.

The minimum displacements during the data acquisition period are obtained by subtracting the initial position from each element in the displacement vector (shown at 64). That is, $$|x\rangle_{min}=|\hat{x}\rangle-\hat{x}_1|u_0\rangle \tag{22}$$

where $\hat{x}_1$ is the first entry in $|\hat{x}\rangle$. The operation in step 62 is equivalent to removing the constant dependencies from the displacement vector. The norms of the vectors $|u_1\rangle$ are needed in equations (21) and (22) and can be computed by straightforward algebra using well known summation formulae. See, for example, Jolley, L. B. W., Summation of Series, Dover Publications, Inc., 1961. The norms of the vectors $|u_1\rangle$ are:

$$\rangle\bar{u}_0|\bar{u}_0\rangle=n_s \tag{23a}$$

$$\langle\bar{u}_1\mid\bar{u}_1\rangle=\frac{n_s(n_s+1)(n_s-1)}{12} \tag{23b}$$

$$\langle\bar{u}_2\mid\bar{u}_2\rangle=\frac{n_s(n_s^2-1)(n_s^4-4)}{180} \tag{23c}$$

The norms shown in equations (23a) through (23c) do not change and can be calculated prior to starting the process of acquiring the acceleration samples and estimating a lower bound on the displacement of the logging tool 18 (shown at 66). As in the previous method, if the lower bound determined in step 64 exceeds a predetermined threshold, a flag can be raised (shown at 68). The algorithm described in FIG. 5 is mathematically equivalent to minimizing the sum of squares of equation (9) with respect to $\dot{x}_1$ and $g_x$. The lower bounds computed by the methods described in FIGS. 4 and 5 are comparable.

In operations, the logging tool 18 is moved along the borehole 14 to make measurements. The sonde 22 makes NMR measurements by magnetically tipping the nuclear spins of protons in the formation with pulses of the oscillating magnetic field $B_1$, and then detecting the precession of the tipped particles in the resonance volume 42. The accelerometer 44 measures the acceleration of the logging tool 18 during the NMR measurements. The acceleration signals from the accelerometer 44 may be transmitted to the surface in real time or stored in a memory and later transmitted to the surface. At the surface, the acceleration signals may be amplified and then processed. Using the methods described above, the computer 43 computes the true displacements of the logging tool 18 during data acquisition along the three orthogonal axes of the logging tool 18. These true displacements can then be used to isolate portions of the NMR log that may be distorted by motions of the logging tool 18. For example, for T2 relaxation-time measurements, the true displacements along the radial axis of the logging tool 18 can be used to identify invalid data in the NMR log. For T1 relaxation-time measurements, the true displacements along the axial axis of the logging tool 18 is used to assess the quality of the log. It should be clear that the methods described above are not limited to the specific configuration of the logging tool 18 shown in FIGS. 2 and 3, but can be used to determine true displacements of any logging tool in general, regardless of whether the logging tool is used alone or is included in other assemblies, e.g., a drill string.

While the invention has been described with respect to a limited number of embodiments, those skilled in the art will appreciate that other embodiments can be devised which do not depart from the scope of the invention as disclosed herein. Accordingly, the scope of the invention should be limited only by the attached claims.

What is claimed is:

1. A method for determining the displacements of a logging tool during a measurement interval of the logging tool in a borehole, the method comprising:

obtaining a set of accelerometer signals corresponding to accelerations of the logging tool along each of three orthogonal axes of the logging tool during the measurement interval;

double integrating the set of accelerometer signals to obtain corresponding displacements of the logging tool as a function of the initial velocity of the logging tool and the gravitational acceleration, wherein the initial velocity of the logging tool and the gravitational acceleration are unknown;

assuming a set of feasible initial velocities for the logging tool;

for each feasible initial velocity, estimating the gravitational acceleration, calculating the displacements of the logging tool using the feasible initial velocity and the estimated gravitational acceleration, and determining the maximum of the calculated displacements; and setting a lower bound on the displacements of the logging tool to the minimum of the maximum of the calculated displacements.

2. The method of claim 1, wherein estimating the gravitational acceleration comprises minimizing the sum of the square of the displacements with respect to the unknown gravitational acceleration.

3. The method of claim 1, wherein estimating the gravitational acceleration includes averaging the accelerometer signals.

4. A method for improving the quality of measurements made by a logging tool during a measurement interval in a borehole, the method comprising:

obtaining a set of accelerometer signals corresponding to accelerations of the logging tool along each of three orthogonal axes of the logging tool during the measurement interval;

double integrating the set of accelerometer signals to obtain corresponding displacements of the logging tool as a function of the initial velocity of the logging tool and the gravitational acceleration, wherein the initial velocity of the logging tool and the gravitational acceleration are unknown;

assuming a set of feasible initial velocities for the logging tool;

for each feasible initial velocity, estimating the gravitational acceleration, calculating the displacements of the logging tool using the feasible initial velocity and the estimated gravitational acceleration, and determining the maximum of the calculated displacements;

estimating a lower bound for the displacements of the logging tool by selecting the minimum of the maximum displacements; and raising a flag if the lower bound for the displacements of the logging tool exceeds a selected threshold.

5. A method for logging a well, comprising:

moving a logging tool along a borehole to make measurements in a formation surrounding the borehole;

recording the measurements made by the logging tool;

measuring accelerations of the logging tool along each of three orthogonal axes of the logging tool during the measurement interval;

double integrating the set of accelerometer signals to obtain corresponding displacements of the logging tool as a function of the initial velocity of the logging tool and the gravitational acceleration, wherein the initial velocity of the logging tool and the gravitational acceleration are unknown;

assuming a set of feasible initial velocities for the logging tool;

for each feasible initial velocity, estimating the gravitational acceleration, calculating the displacements of the logging tool using the feasible initial velocity and the estimated gravitational acceleration, and determining the maximum of the calculated displacements;

estimating a lower bound for the displacements of the logging tool by selecting the minimum of the maximum displacements; and raising a flag if the lower bound for the displacements of the logging tool exceeds a selected threshold.

6. A method for determining displacements of a logging tool during a measurement interval of the logging tool in a borehole, the method comprising:

obtaining a set of accelerometer signals corresponding to accelerations of the logging tool along each of three orthogonal axes of the logging tool during the measurement interval;

calculating a tool displacement as a time-series from the accelerometer signals;

constructing a unique quadratic polynomial of time from the displacement time-series; and subtracting the unique quadratic polynomial from the displacement time-series; and setting the lower bound to the maximum of the remainder of the displacement time-series.

7. The method of claim 6, wherein calculating a tool displacement as a time-series from the accelerometer signals includes setting the second time-derivative of the position of the logging tool to the acceleration of the logging tool.

8. The method of claim 7, further comprising replacing the second time-derivative of the position of the logging tool with a central-difference approximation.

9. The method of claim 8, further comprising constructing a system of equations from the central-difference approximation and the acceleration of the logging tool and solving the system of equations to obtain the tool displacement.

10. The method of claim 7, wherein constructing a unique quadratic polynomial of time from the displacement-time series comprises combining elementary polynomials.

11. A method for improving the quality of measurements made by a logging tool during a measurement interval in a borehole, the method comprising:

obtaining a set of accelerometer signals corresponding to accelerations of the logging tool along each of three orthogonal axes of the logging tool during the measurement interval;

calculating a tool displacement as a time-series from the accelerometer signals;

constructing a unique quadratic polynomial of time from the displacement time-series;

subtracting the unique quadratic polynomial from the displacement time-series; and setting the lower bound to the maximum of the remainder of the displacement time-series; and raising a flag if the lower bound for the displacements of the logging tool exceeds a selected threshold.

* * * * *